US006398123B1

(12) United States Patent
Clisby et al.

(10) Patent No.: US 6,398,123 B1
(45) Date of Patent: Jun. 4, 2002

(54) RAILWAY FASTENING ANCHOR AND CLIP

(76) Inventors: Orville L. Clisby; Harold W Clisby, both of 12 Norton Summit Road, Magill South Australia 5072 (AU)

( * ) Notice: Subject to any disclaimer, the term of this patent is extended or adjusted under 35 U.S.C. 154(b) by 0 days.

(21) Appl. No.: 09/357,842

(22) Filed: Jul. 21, 1999

(30) Foreign Application Priority Data

Jul. 22, 1998 (AU) ..... PP4801
Aug. 11, 1998 (AU) ..... PP5205

(51) Int. Cl.[7] ..... E01B 13/00
(52) U.S. Cl. ..... 238/315; 238/351
(58) Field of Search ..... 238/310, 315, 238/338, 349, 351, 353, 534, 29, 83, 88

(56) References Cited

U.S. PATENT DOCUMENTS 4,489,885 A 12/1984 Bryan ..... 238/349
4,600,145 A * 7/1986 Geddes ..... 238/351
4,632,307 A * 12/1986 Weber ..... 238/265
4,770,343 A * 9/1988 Heim et al. ..... 238/349
4,778,106 A * 10/1988 Diener et al. ..... 238/349
4,913,343 A * 4/1990 Harkus ..... 238/351
4,943,006 A 7/1990 Clark et al. ..... 238/349
4,109,860 A * 10/1998 Serafin et al. ..... 238/349
5,820,021 A * 10/1998 Rex ..... 238/351

FOREIGN PATENT DOCUMENTS

AU 576830 9/1988
GB 2 097 453 11/1982

* cited by examiner

*Primary Examiner*—S. Joseph Morano
*Assistant Examiner*—Robert J. McCarry, Jr.
(74) *Attorney, Agent, or Firm*—Finnegan, Henderson, Farabow, Garrett & Dunner, L.L.P.

(57) ABSTRACT

A rail fastening system which comprises an anchor embedded in the sleeper or crosstie and a clip to engage under the anchor, one end of the clip engaging the flange of the rail and the other end of the clip engaging the surface of the sleeper or crosstie.

16 Claims, 8 Drawing Sheets

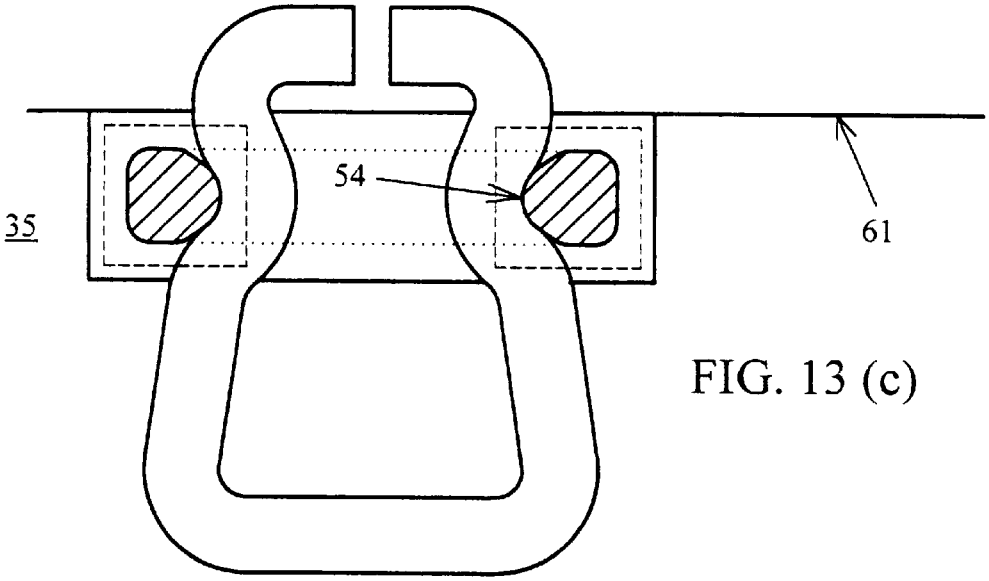
FIG. 13 (c)
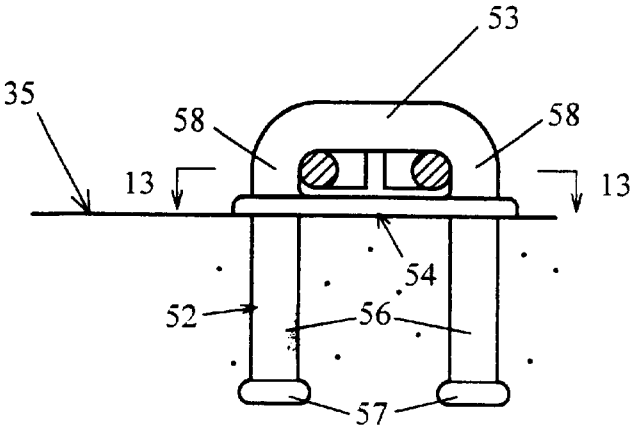
FIG. 13 (a)
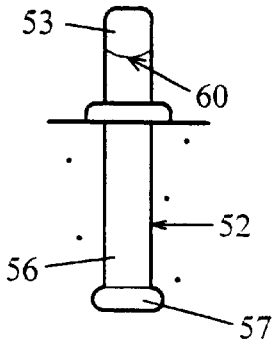
FIG. 13 (b)
FIG. 13

RAILWAY FASTENING ANCHOR AND CLIP

This invention relates to a railway fastening anchor and clip, particularly to a clip for fastening a rail to a base such as a sleeper or crosstie and more particularly to the fastening of a rail to a concrete sleeper or crosstie.

BACKGROUND OF THE INVENTION

Rails are known to be fastened to concrete sleepers by various fastening means such as clips or the like, the clips engaging the rail flange and also an anchor embedded into or attached to the sleeper.

One such known fastening means is disclosed in U.S. Pat. No. 4,943,006 where each sleeper has embedded therein four shoulders each of inverted U shape. These shoulders are formed of sheet metal to a critical shape and have an opening for the toe of a clip to be inserted under the shoulder and be locked into and engaging in a recess formed in the shoulder. Each of the components, the shoulder and the clip have to be formed by complex forging or bending operations.

United Kingdom Patent No. 2,097,453 also discloses a clip assembly for attachment of a rail to a wooden sleeper in which the anchoring members are located in holes in the wooden sleeper and anchored therein by an epoxy resin. The anchoring members are formed by pressing an elongate flat piece of steel. Clips of complex C shape are driven under the anchoring members in a direction along the length of the rail. The clips and anchoring members are formed by forming and bending.

U.S. Pat. No. 4,489,885 describes an L shaped anchor embedded in the concrete sleeper. A clip of spring metal having a multiple curved cross section in which the curved members undulate is inserted under the L shaped anchor and engages the rail flange at one end. The other end of the clip engages a pad on the sleeper.

Further examples of clips attaching rails to a sleeper are shown In U.S. Pat. No. 4,913,343 and Australian Patent No. 576830.

However as noted various of the known systems require complex forging operations of flat sheet metal to form the clips and/or the anchorages, and also in various of the known systems there does not appear to be any provision for preventing the clip from becoming dislodged. This is particularly so where the clip is inserted longitudinally of the rail.

Thus it is an object of the invention to provide a rail fastening system in which the component parts are easy to manufacture. A further object of the invention is to provide a rail fastening system in which each of the component parts are simply formed, the anchor is formed by a simple forging or casting operation and the clip by a simple bending operation of a steel rod.

Another object of the invention is to provide a rail fastening system in which the clip is virtually prevented from becoming loose and dislodged by the passage of trains along the rails or by rail expansion and contraction.

BRIEF STATEMENT OF THE INVENTION

Thus there is provided according to the invention a rail fastening means having an anchor and a clip for securely fastening a rail on a sleeper, crosstie or other base, the anchor being embedded in and extending from the surface of the sleeper or crosstie spaced from the position of the rail on the sleeper or crosstie and having at least one portion extending laterally of the anchor and spaced from the surface of the sleeper or crosstie, said clip engaging under at least one laterally extending portion to engage a flange of the rail at one end thereof with the other end supported by the sleeper or crosstie, said clip having a pair of arms resiliently biased to engage the anchor to firmly locate the clip relative to the anchor and locate the rail in position on the sleeper.

There is also provided according to the invention an anchor and clip for securely locating a rail on a sleeper, crosstie or other base, the anchor comprising a post or the like embedded in the sleeper or crosstie, the post having a head spaced from the surface of the sleeper or crosstie, and the clip engaging under the headed, one end of the clip engaging the rail flange and the other end engaging the sleeper or crosstie, the clip having a pair of arms resiliently biased to each other so that when in use they engage opposite surfaces of the post.

There is also provided according to the invention a rail fastening means, said means including an anchor embedded into a sleeper, and a clip to engage under the anchor and engage on the rail flange and the sleeper at a position spaced from the anchor, said anchor being U shaped with legs embedded in the sleeper and an upper generally horizontal fulcrum, the clip being generally C shaped with opposite sides of the C being a mirror image of each other and having recesses within which the legs of the anchor engage, with the upper portion of the clip engaging the undersurface of the fulcrum.

BRIEF DESCRIPTION OF THE DRAWINGS

In order to more fully describe the invention reference is now made to the accompanying drawings in which:

FIG. 7(*a*) being a partial side elevation of the fastening means and FIG. 7(*b*) a perspective view of an insulator, FIG. 13 is a still further embodiment of the invention.

DESCRIPTION OF THE PREFERRED EMBODIMENT

Figure 2:
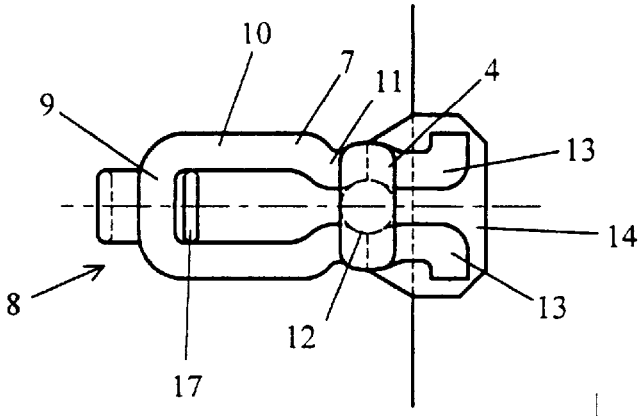
FIG. 2 is a plan view of the post and clip.

The rail 1 is shown on a concrete sleeper 2. The anchor comprises a post or bolt 3 having a head 4 and a leg 5 to anchor the post or bolt in the concrete sleeper, the head 4 preferably being generally rectangular in plan and extending on opposite sides of the post or bolt in the longitudinal direction of the rail. The head 4 is undercut 6 on each side to receive the respective arms 7 of the clip 8.

As shown the clip is of elongated U shape, the arms 7 being connected to a base 9 of the clip. The arms have a portion 10 parallel to each other and then are bent towards each other 11 to be formed with a recess 12 to engage around the post, the arms after the recess being shaped to be spaced from each other at a lesser distance than the diameter of the post, the outer ends of the arms 13 then diverging away from each other.

Thus it will be seen that when the clip is positioned with the ends of the arms adjacent the head of the post, that a blow to the base of the clip will cause the arms to spread and the post be engaged in the recesses in the arms. Due to the resiliency of the clip the clip is strongly retained in position with ends of the arms engaging the flange of the rail and the base of the clip engaging the upper surface of the sleeper.

As shown the arms engage an insulator 14 on the rail flange, but it will be realised that in some installations an insulator will not be required.

Preferably the base of the clip also engages a base anchor 15 which has a leg 16 embedded in the concrete sleeper to protect the concrete surface from the pressure of the clip, and the base anchor locating the clip in position on the sleeper by a tongue 17 engaging the arms 7 of the clip adjacent the base 9 of the clip. The tongue 17 engages with the internal sides of the arms 7 of the clip to assist with preventing movement or rotation of the clip relative to the base anchor due to expansion or contraction of the rail.

Figure 4:
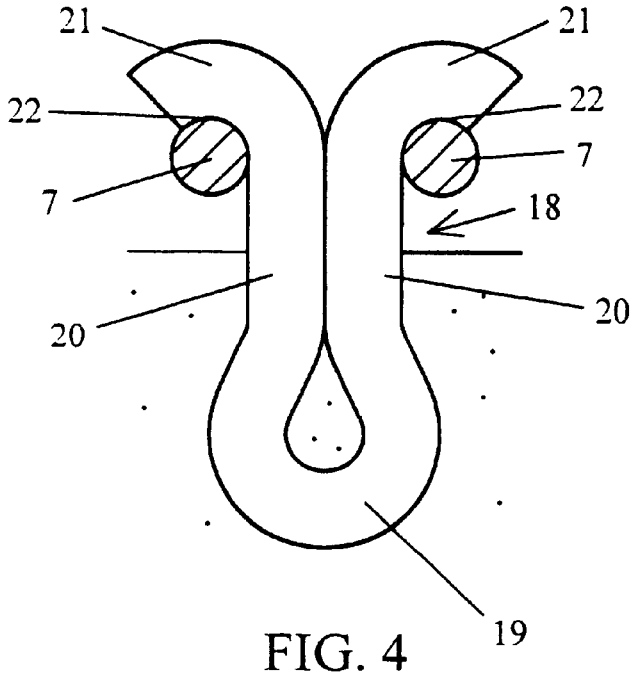
FIG. 4 is a view of a further embodiment of a post.

FIG. 4 shows a second embodiment of the invention wherein the post 18 is formed by bending a rod to provide a 180° bend 19 and form two legs 19 adjacent each other. Each of the arms 20 are bent at their end 21 outwardly or away from each other to each form a recess 22 to receive the arms 7 of the clip. The enlarged end of the post formed by the bend in the rod forming the post creates a secure anchor for the post cast into the concrete sleeper. Thus the post can be formed by a simple bending operation, the ends 21 forming the recesses 22 securely retaining the clip in position.

Figure 5:
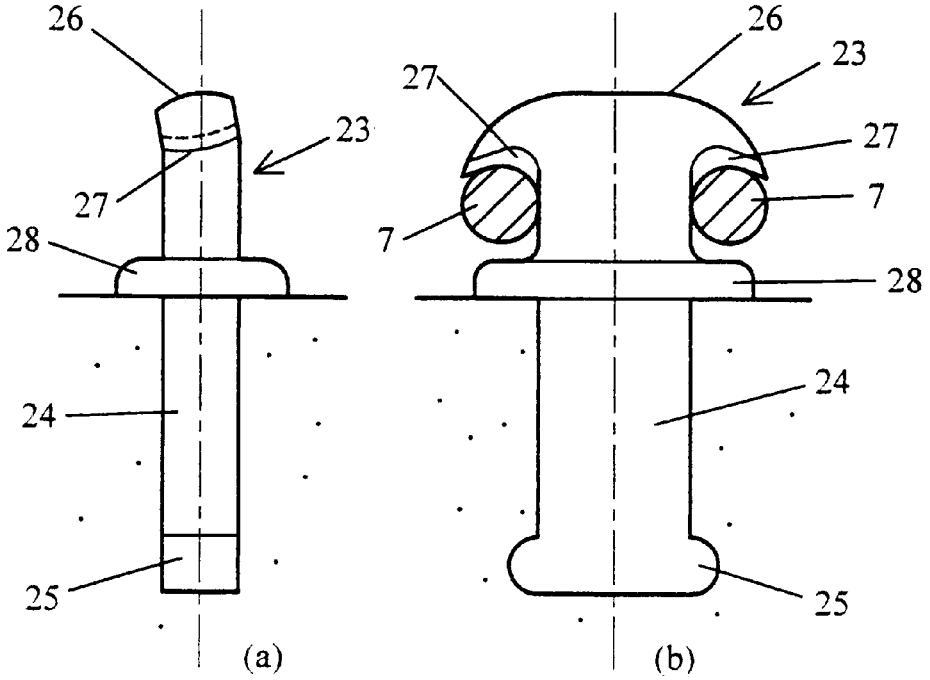
FIGS. 5(*a*) and 5(*b*) are views of a still further embodiment of a post.
Figure 6:
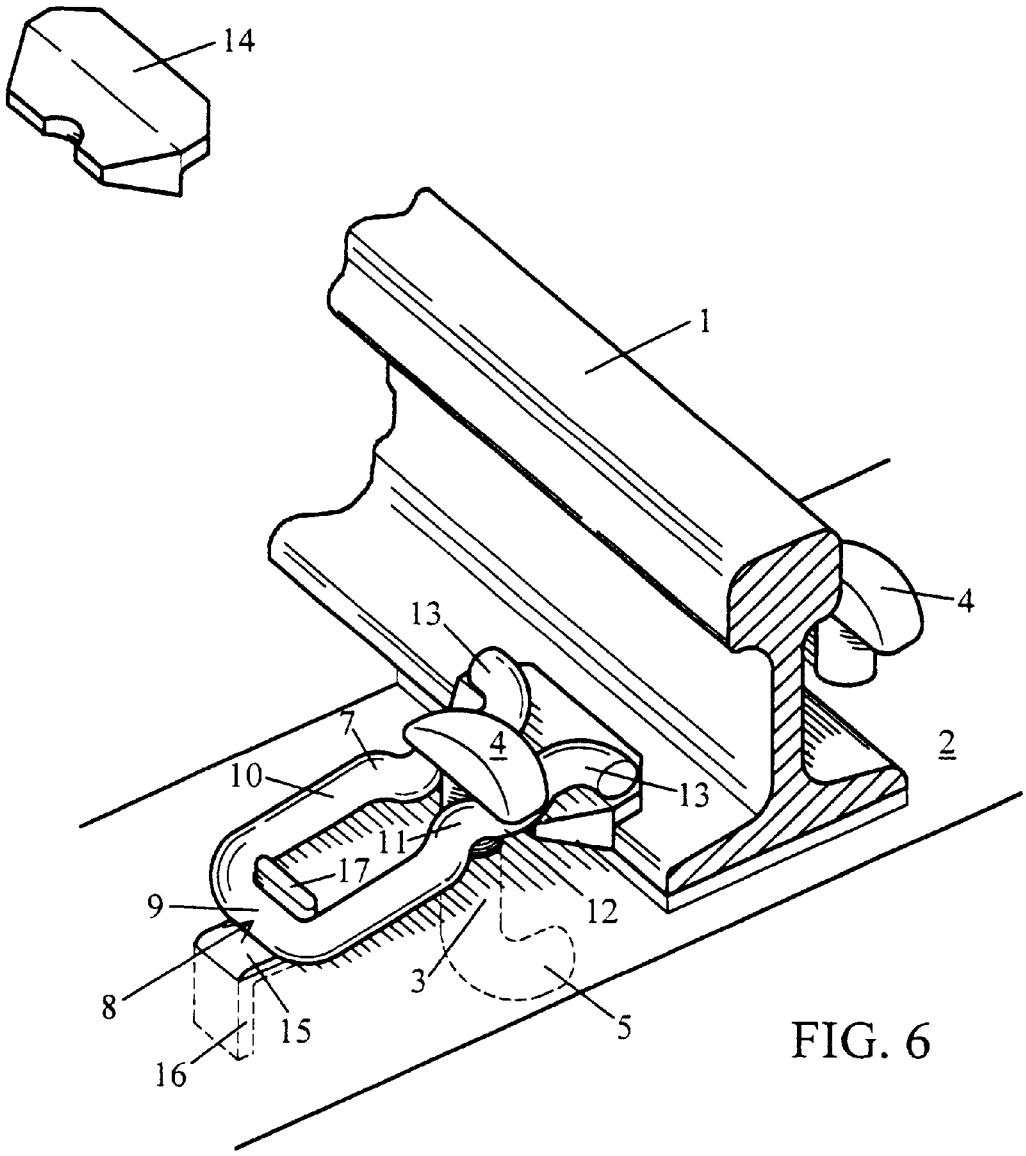
FIG. 6 is a perspective view of the embodiment of FIGS. 1 to 3

A further embodiment of a post is shown in FIG. 6, the post 23 being cast with a stem 24 and an enlarged end 25 to anchor the post in the concrete sleeper, the stem and enlarged end being generally rectangular in cross section. The post has a head 26 formed with a pair of recesses 27, one on each side of the head, which recesses receive the arms 7 of the clip. As shown in FIG. 5(*a*), the portion of the head forming the recesses is inclined from the vertical. This inclination when the post is cast into the sleeper is away from the sleeper and toward the clip so that the recess is then at the same angle as the slope of the clip when the clip is inserted in the recesses and engages the flange of the sleeper. The post also preferably includes a flange 28 so positioned that when the post is cast into the sleeper the flange 28 is on the surface of the sleeper. The purpose of the flange 28 is to prevent or minimise the possible entry of water down the sides of the stem of the post.

Thus it will be seen that the invention provides an anchor and clip both of which are easy to manufacture and install. The post and the base anchor are cast into the sleeper during the casting of the sleeper, and to install the clip it is placed in position and by a single blow, either manually from a hammer or by pressure from a machine, the clip is installed under the head. The pressure is applied to the rail flange by engagement of the clip under the head, the base of the clip engaging the sleeper or base anchor.

Referring to FIGS. 7 to 12 of the drawings which show a further embodiment of the invention there is shown the rail 31 on the sleeper 32. Into the sleeper there is cast the anchor 33 having legs 34 and a cross bar fulcrum 35. Preferably each leg is anchored in the concrete, in this embodiment provided by a bend 36 in the lower portion of each leg. As shown the anchor is made from a rod of metal, preferably circular in cross section, and thus can be formed by a simple bending operation. Preferably the anchor and more particularly the legs thereof are zinc plated to prevent rusting of the legs.

The clip 37 is also formed by bending a rod of spring steel, the clip having a base 38, a pair of side arms 39 each terminating in an end portion 40 bent and facing each other but spaced from each other to provide a gap 41. Each of the side portions has an outwardly facing spring snap radius or recess 42 into which the respective legs 44 of the anchor engage. As shown in the drawings, the side arms 39 slope towards each other when the clip is positioned in the anchor, however before assembly the side arms 39 would be generally parallel to each other thus causing gap 41 to be greater than illustrated. This gap 41 is provided to permit the side arms 39 to move towards each other as the clip 37 is driven through the anchor 33.

Figure 1:
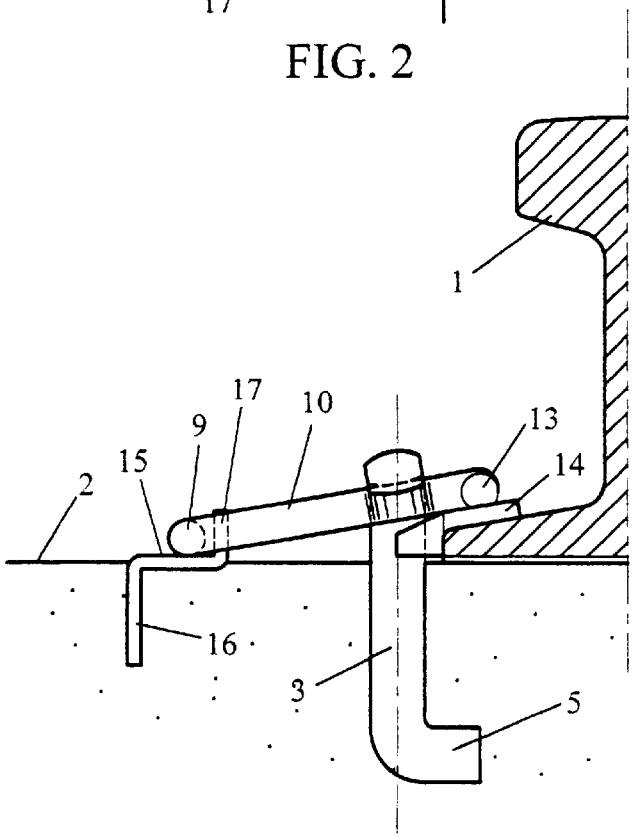
FIG. 1 is a side view of the invention in position on a rail.
Figure 3:
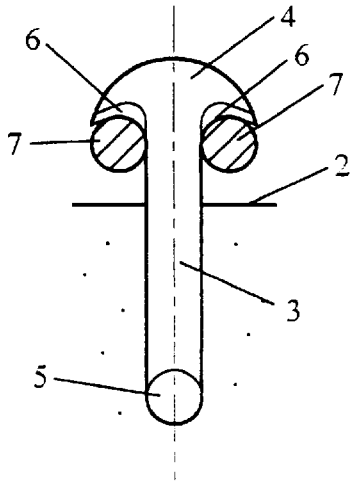
FIG. 3 is a cross sectional view of the post and clip portions.

As illustrated in the embodiment of FIGS. 1 and 2, the rail 31 is insulated from the rail fastening means by an insulation pad 43 which is moulded to shape. The pad 43 has recesses 44 to accommodate the legs 34 of the anchor and a slope or bevel portion 35 onto which the end portions 30 engage. The insulation pad is positioned on the flange 31 of the rail, the insulation pad being sufficiently incompressible and rigid to take the compressive forces applied by the clip through the insulation pad onto the rail to securely locate the rail in position on the sleeper.

In order to securely locate the clip in position, the sleeper has cast therein a locating stop 46 which has an inclined surface 47 rising from the surface of the sleeper to a position above the sleeper. At this position the stop has a radiused retainer portion 48 into which the base 38 of the clip engages when the clip is inserted in position. The locating stop preferably has an anchor leg 46(*a*) extending into the concrete sleeper to locate the stop and to resist the clamping force of the clip on the rail.

The relationship between the distance of the undersurface of the cross bar fulcrum 35 and the upper surface of the sleeper, the diameter of the clip, and the position of the bevel surface or slope 45, and also the locating stop is such that when a clip is positioned to be inserted and struck with a blow on the base 38, the base 38 will rise up the slope 47 with the portions 40 of the clip passing through the legs 34 by arms springing towards each other which is permitted by the gap 41. On insertion the clip engages on the undersurface of the fulcrum bar 35, on the insulation pad and the locating stop 46 to securely hold the rail in position.

The clips can be installed manually or by a rail laying machine.

Figure 7:
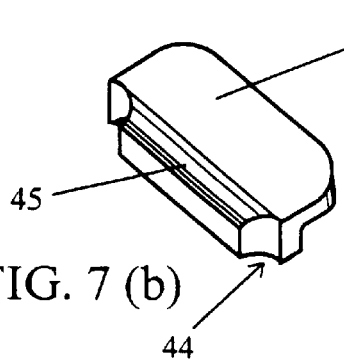
FIG. 7 is a perspective view of a further embodiment of the fastening means applied to a rail.
Figure 7:
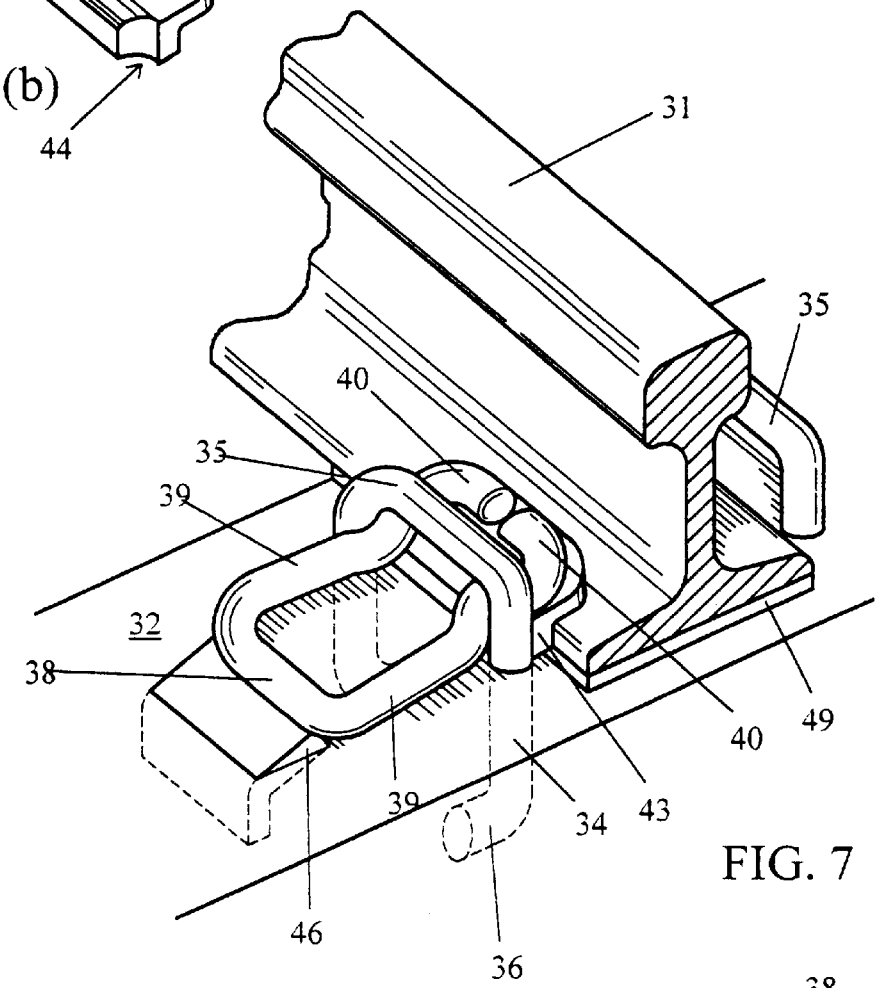
Figure 7:
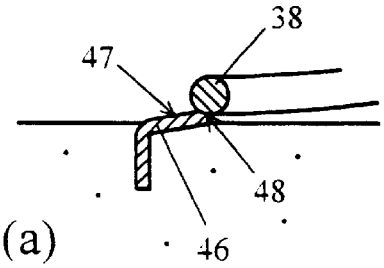

FIG. 7 also shows an insulation pad 49 positioned between the rail and the sleeper.

Figure 8:
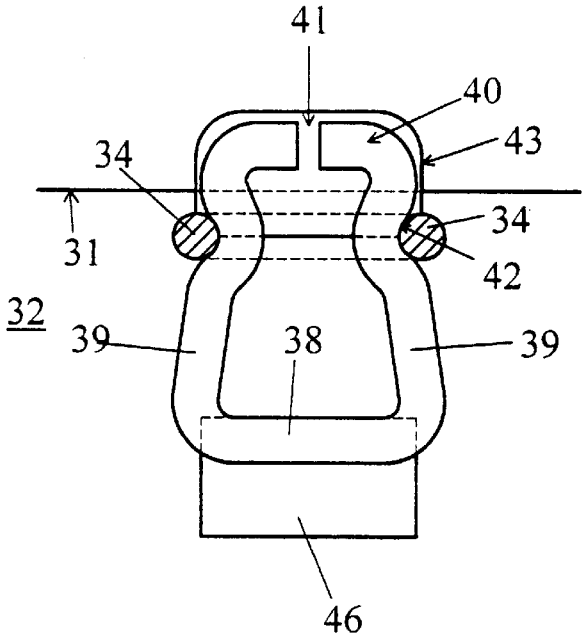
FIG. 8 is a plan view of FIG. 1.
Figure 9:
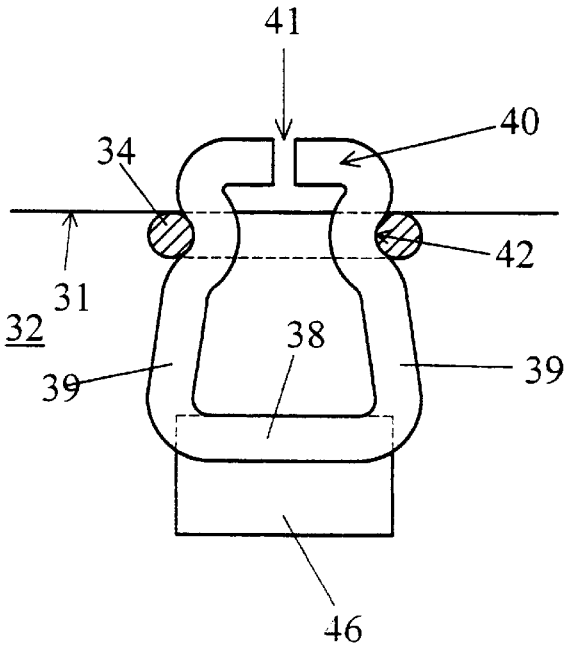
FIG. 9 is a plan view similar to FIG. 2 illustrating the fastening means without insulation.

FIG. 9 illustrates the use of a clip according to the invention but without an insulation pad and the insulation underneath the sleeper, like items being indicated with the same reference numeral as in FIGS. 7 and 8. However it is to be realised that the anchor in this embodiment will be cast in the sleeper closer to the upper surface of the sleeper than with the use of insulation pads so that the required pressure is applied to the flange of the rail to retain the rail in position.

Figure 10:
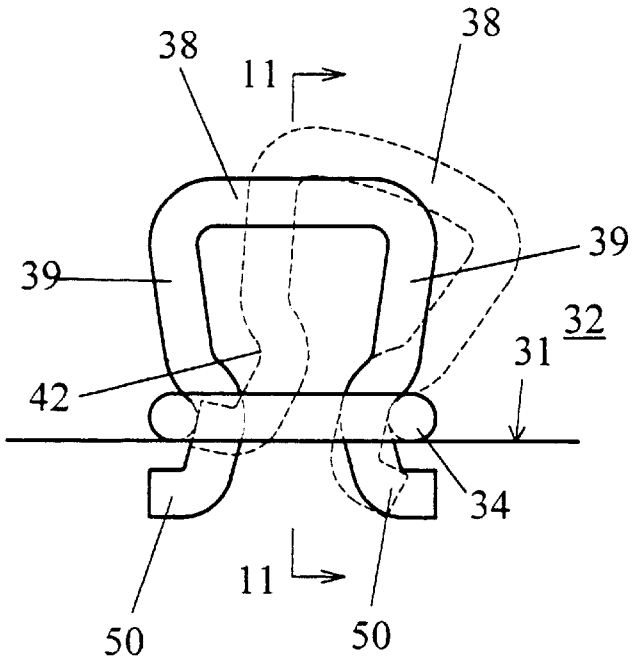
FIG. 10 is a plan view of a second embodiment of the invention showing the clip in two positions, being inserted and after insertion.
Figure 12:
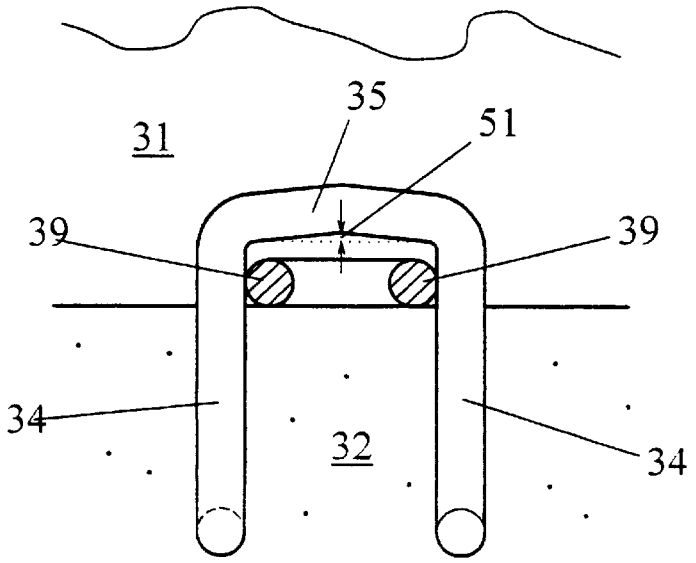
FIG. 12 is a view of the anchor and the inserted clip.
Figure 11:
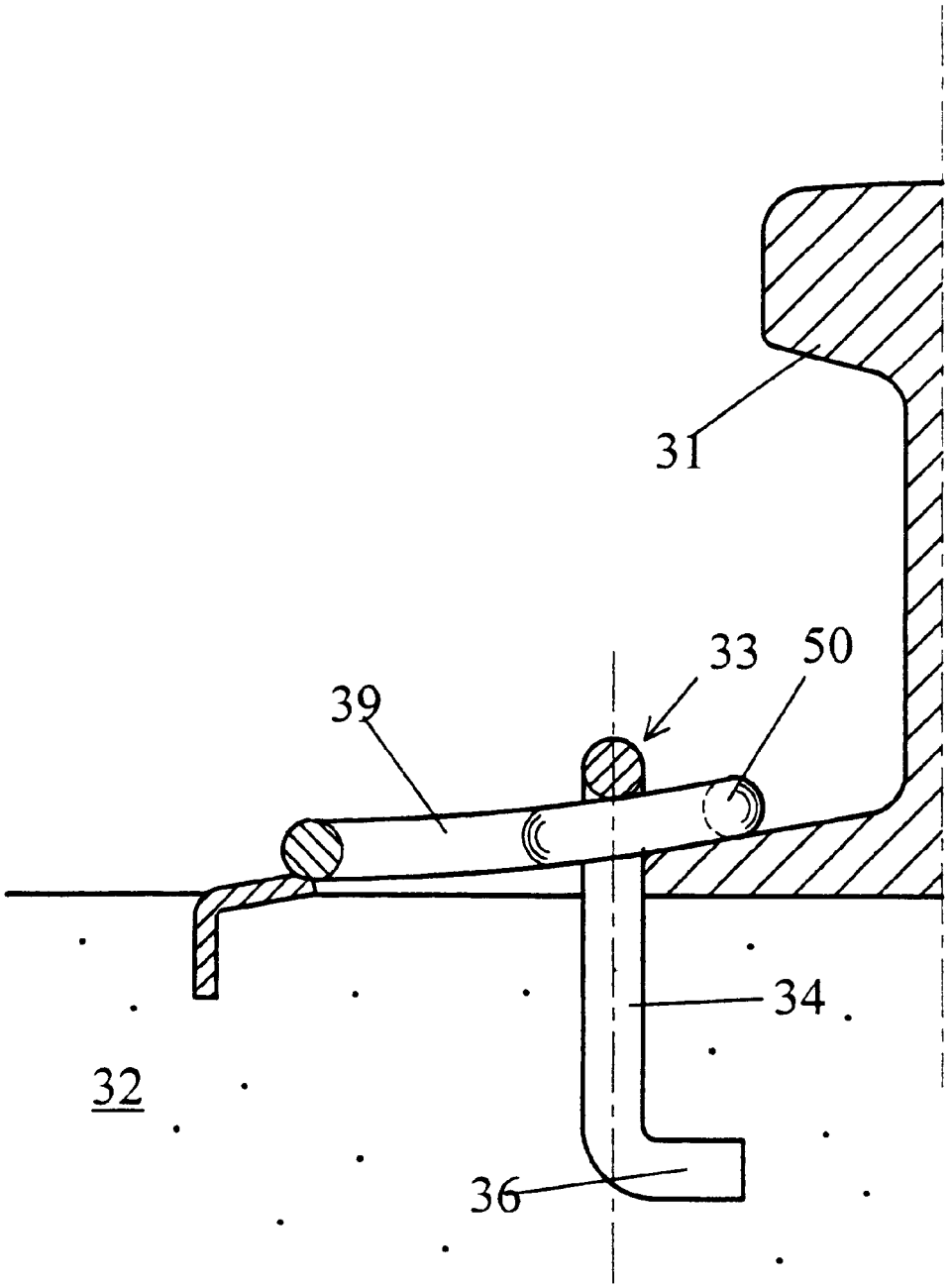
FIG. 11 is a view on lines 5—5 of FIG. 4.

FIGS. 10 to 12 illustrate a further embodiment of the invention. In this embodiment the clip 37 has a base 38 and side arms 39 and recess 42. However instead of the clip having intumed portions, the clip has outwardly turned portions 50. As shown in FIG. 4 the clip is inserted by inserting one leg under the anchor, and then by the use of a tool to compress or squeeze the arms together the clip is inserted under the anchor. Also the fulcrum bar of the anchor is slightly upwardly curved 51 to facilitate insertion and removal of the clip.

In a further embodiment of the invention as shown in FIG. 13 there is shown in side elevation, part sectional end elevation and a sectional view along the lines 13—13 of a cast steel anchor 52. The anchor has a U shaped fulcrum portion 53 extending from base 64 which sits on the upper surface of the sleeper 55. The anchor has a pair of depending legs 56 each with a foot to anchor the anchor 52 in the concrete sleeper. The U-shaped fulcrum has radiused portions 59 to complement the portions of the clip inserted under the fulcrum and also a radiused portion 60 to facilitate the insertion of the clip under the fulcrum. The edge of the rail 61 is closely adjacent to or abuts the edge of the anchor so that the clip inserted under the fulcrum portion is forced over the flange of the rail.

Thus it can be seen that the invention provides a rail railway fastening means in which the anchor and the clip are produced from steel rods by simple bending, and in which the clips can be inserted in a simple manner, or the anchor produced by casting. By having the clips inserted at right angles to the rails and located positively on the sleeper, the problem of the clips becoming dislocated is minimised, and although various embodiments of the invention have been described in some detail, the invention is not to be limited thereto but can include variations and modifications falling within the spirit and scope of the invention.

What is claimed is:

1. A rail fastening system for securely fastening a rail on a concrete support, comprising:

an anchor adapted to be cast into and extend from a surface of the concrete support and having at least one laterally extending portion fixedly spaced from the surface of the concrete support, a clip having a base and a pair of arms fabricated from steel of circular cross-section, said clip engaging under the at least one laterally extending portion to engage a flange of the rail at one end with the other end thereof supported by the concrete support, the pair of arms being resiliently biased to engage the anchor to firmly locate the clip relative to the anchor and locate the rail in position on the concrete support, and a base support adapted to be embedded in the concrete support, said base support having an upstanding portion to engage the base of the clip between the arms thereof to prevent lateral movement of the clip along the concrete support, whereby the fastening system is assembled by positioning the rail flange adjacent and spaced from said anchor and forcing said clip under the laterally extending portion and onto the flange of the rail using the resiliency of the clip.

2. A rail fastening system as defined in claim 1 wherein the anchor is a post embedded in the concrete support, said post having a head under which said arms of the clip engage.

3. A rail fastening system as defined in claim 2 wherein the arms of the clip are biased towards each other so that the arms resiliently engage opposite sides of the post.

4. A rail fastening system as defined in claim 2 wherein the clip is U shaped to have a base and two arms with the base of the clip supported by the concrete support remote from the rail, each of said arms being so shaped to partially embrace the post, the arms engaging the flange of the rail.

5. A rail fastening system as defined in claim 2, wherein said post has an extending portion or leg embedded in said concrete support to prevent removal of the post.

6. A rail fastening as defined in claim 1 the anchor is fabricated from a steel rod.

7. A rail fastening system as defined in claim 6 wherein the anchor is a single rod having a head formed thereon.

8. A rail fastening system as defined in claim 6 wherein the anchor is formed by a rod doubled on itself, the bend being embedded in the concrete support and the ends of the rod being splayed to form the laterally extending portion under which the clip engages.

9. A rail fastening system as defined in claim 1 wherein the anchor is cast as a post having an enlarged lower portion to anchor the post in the concrete support, a flange to engage the upper surface of the concrete support, and an enlarged head having opposite flanges under which the arms of the clip engage.

10. A rail fastening system as defined in claim 1 wherein said anchor is U shaped to have a base and two legs with the legs of the anchor embedded in the concrete support and the base of the anchor spaced above the surface of the support under which the clip engages.

11. A rail fastening system as defined in claim 10 wherein the clip is U shaped to have two arms with the arms of the clip passing between the legs of the anchor, the arms of the clip being so formed to engage the legs of the anchor to be securely located there between.

12. A rail fastening system as defined in claim 11 wherein the ends of the arms of the clip extend towards each other but with sufficient clearance that the arms may be forced towards each other to enable the clip to be inserted between the arms of the anchor.

13. A rail fastening system as defined in claim 12 wherein the ends of the arms of the clip diverge from each other.

14. A rail fastening system as defined in claim 1 wherein an electrical insulator is positioned between the end of the clip and the rail flange.

15. A rail fastening system as defined in claim 1 wherein the anchor is cast in U shape to have two legs with a horizontal flange extending from one leg to the other to engage the top surface of the concrete support.

16. A rail fastening system comprising:

an anchor to be embedded into a sleeper or cross tie; and a clip fabricated from a steel rod of circular cross section to engage under the anchor and engage on a flange of a rail and also engage on the sleeper or cross tie at a position spaced from the anchor, said anchor being U shaped with legs adapted to be embedded in the sleeper or cross tie, and having an upper generally horizontal fulcrum, said clip being generally C shaped with extending legs having recesses to engage the respective legs of the anchor, when inserted through the anchor, and engage under the fulcrum of the anchor.

* * * * *

UNITED STATES PATENT AND TRADEMARK OFFICE

CERTIFICATE OF CORRECTION

PATENT NO. : 6,398,123 B1
DATED : June 4, 2002
INVENTOR(S) : Orville L. Clisby et al.

It is certified that error appears in the above-identified patent and that said Letters Patent is hereby corrected as shown below:

Title page,
Item [76], Inventors, after "Harold W" insert a period -- . --; and after "Magill" insert a comma -- , --.

Column 6,
Line 9, after "fastening" insert -- system --.
Line 9, after "claim 1" insert -- wherein --.

Signed and Sealed this

Twenty-ninth Day of April, 2003

JAMES E. ROGAN
*Director of the United States Patent and Trademark Office*